US012708147B2

(12) United States Patent
Chan et al.

(10) Patent No.: US 12,708,147 B2
(45) Date of Patent: Aug. 18, 2026

(54) DEVICE WITH DRIVE ASSEMBLY FOR AN AEROSOL PROVISION SYSTEM

(71) Applicant: Nicoventures Trading Limited, London (GB)

(72) Inventors: Justin Han Yang Chan, London (GB); Patrick Moloney, London (GB)

(73) Assignee: Nicoventures Trading Limited, London (GB)

( * ) Notice: Subject to any disclaimer, the term of this patent is extended or adjusted under 35 U.S.C. 154(b) by 591 days.

(21) Appl. No.: 18/245,176

(22) PCT Filed: Aug. 31, 2021

(86) PCT No.: PCT/GB2021/052251
§ 371 (c)(1),
(2) Date: Mar. 14, 2023

(87) PCT Pub. No.: WO2022/053780
PCT Pub. Date: Mar. 17, 2022

(65) Prior Publication Data

US 2023/0346036 A1 Nov. 2, 2023

(30) Foreign Application Priority Data

Sep. 14, 2020 (GB) ..... 2014416

(51) Int. Cl.
*A24F 40/485* (2020.01)
*A24F 40/51* (2020.01)
*A24F 40/10* (2020.01)

(52) U.S. Cl.
CPC ..... *A24F 40/485* (2020.01); *A24F 40/51* (2020.01); *A24F 40/10* (2020.01)

(58) Field of Classification Search
None
See application file for complete search history.

(56) References Cited

U.S. PATENT DOCUMENTS

2014/0283855 A1 9/2014 Hawes et al.
2015/0027470 A1 1/2015 Kane et al.
(Continued)

FOREIGN PATENT DOCUMENTS

CN 203709254 U 7/2014
CN 203748678 U 8/2014
(Continued)

OTHER PUBLICATIONS

"International Preliminary Report on Patentability received for International Patent Application No. PCT/GB2021/052251, mailed on Mar. 23, 2023", 8 Pages.
(Continued)

*Primary Examiner* — Philip Y Louie
*Assistant Examiner* — John Mitchell Martin
(74) *Attorney, Agent, or Firm* — Merchant & Gould P.C.

(57) ABSTRACT

A device component (20) for an aerosol provision system comprises: a drive rod (41) for pushing against a movable plunger (12) in order to displace aerosol generating material through an outlet (15) of a reservoir (3) for storing aerosol generating material; a proximity detector configured to detect a spacing of the drive rod from the plunger; a drive assembly operable to advance the drive rod in a pushing direction, at a first speed to approach the plunger and at a second speed when against the plunger to move the plunger in order to displace aerosol generating material, the first speed being faster than the second speed; and a controller (8) configured to operate the drive assembly to advance the drive rod at the first speed from a spacing of the drive rod from the plunger that exceeds a predetermined spacing, and to cease advancing the drive rod at the first speed in response to detection of a spacing that is substantially equal to or less than the predetermined spacing.

16 Claims, 4 Drawing Sheets

(56) References Cited

U.S. PATENT DOCUMENTS

| | | | | |
|---|---|---|---|---|
| 2016/0021931 | A1 | 1/2016 | Hawes et al. | |
| 2016/0270441 | A1 | 9/2016 | Lewis et al. | |
| 2017/0172211 | A1 | 6/2017 | Batista et al. | |
| 2017/0258140 | A1 | 9/2017 | Rostami et al. | |
| 2018/0177958 | A1 | 6/2018 | Wilder et al. | |
| 2018/0257797 | A1 | 9/2018 | Beer | |
| 2019/0153623 | A1 | 5/2019 | Sugawara et al. | |
| 2019/0208811 | A1 | 7/2019 | Biel et al. | |
| 2019/0344009 | A1* | 11/2019 | Damiano | A61M 5/1684 |
| 2020/0120989 | A1* | 4/2020 | Danek | A61M 11/005 |

FOREIGN PATENT DOCUMENTS

| | | | |
|---|---|---|---|
| CN | 105077599 | A | 11/2015 |
| CN | 105533811 | A | 5/2016 |
| CN | 105581376 | A | 5/2016 |
| EP | 3075271 | A1 | 10/2016 |
| EP | 3162229 | A1 | 5/2017 |
| GB | 2519950 | A | 5/2015 |
| WO | 2013089358 | A1 | 6/2013 |
| WO | 2015084083 | A1 | 6/2015 |
| WO | 2016096728 | A1 | 6/2016 |
| WO | 2016155316 | A1 | 10/2016 |
| WO | 2016178098 | A3 | 11/2016 |

OTHER PUBLICATIONS

International Search Report and Written Opinion received for PCT Patent Application No. PCT/GB2021/052251, mailed on Dec. 23, 2021, 12 pages.

Search Report received for GB Patent Application No. 2014416.8, mailed on Mar. 1, 2022, 3 pages.

* cited by examiner

DEVICE WITH DRIVE ASSEMBLY FOR AN AEROSOL PROVISION SYSTEM

PRIORITY CLAIM

The present application is a National Phase entry of PCT Application No. PCT/GB2021/052251, filed Aug. 31, 2021, which claims priority from GB Application No. 2014416.8, filed Sep. 14, 2020, each of which hereby fully incorporated herein by reference.

TECHNICAL FIELD

The present disclosure relates to a device for an aerosol provision system that comprises a drive assembly, aerosol provision systems including such a device, and a method of operating such a device.

BACKGROUND

Many aerosol provision systems, such as electronic systems including e-cigarettes and other electronic nicotine delivery systems that deliver nicotine by vaporizing or heating a suitable material, are formed from two main components or sections, which may be termed a device and an article. The device is a control or power section or component, and may include a power source such as a battery, and a controller or control unit, comprising electronics configured to operate the system, such as circuitry and/or software. The article may be considered as a cartridge or cartomizer section, and includes a storage area, such as a reservoir, for aerosolizable material, and often an aerosol generator or aerosol generating element such as a heater configured to generate vapor for aerosol formation from the aerosolizable material. The article may be intended to be disposable when the aerosolizable material is exhausted so that it is replaceable with a new article for use in conjunction with the device, where the device is intended to operate over the lifetime of many articles. In such a system, the article as a whole may be termed a consumable or consumable component. Alternatively, the article may include a smaller disposable component or consumable containing the aerosolizable material which can be replaced when exhausted. Particularly in the case of consumable articles, the consumable and the device are separate elements that couple together to form the system.

The reservoir may have a syringe-like configuration, operable to dispense the aerosolizable material by movement of a plunger that reduces the reservoir volume and forces material through an outlet. The plunger can be moved by the action of a pushing element, typically housed in the device and driven therefrom. The pushing element requires accurate control to enable correct dispensing of the aerosolizable material.

Arrangements for controlling the dispensing of aerosolizable material from a syringe-style reservoir are therefore of interest.

SUMMARY

According to a first aspect of some embodiments described herein, there is provided a device component for an aerosol provision system, the device component comprising: a drive rod for pushing against a movable plunger in order to displace aerosol generating material through an outlet of a reservoir for storing aerosol generating material; a proximity detector configured to detect a spacing of the drive rod from the plunger; a drive assembly operable to advance the drive rod in a pushing direction, at a first speed to approach the plunger and at a second speed when against the plunger to move the plunger in order to displace aerosol generating material, the first speed being faster than the second speed; and a controller configured to operate the drive assembly to advance the drive rod at the first speed from a spacing of the drive rod from the plunger that exceeds a predetermined spacing, and to cease advancing the drive rod at the first speed in response to detection of a spacing that is substantially equal to or less than the predetermined spacing.

According to a second aspect of some embodiments described herein, there is provided an aerosol provision system comprising a device component according the first aspect, and a consumable component configured for connection to the device component and comprising a reservoir for storing aerosol generating material and a movable plunger for displacing aerosol generating material through an outlet of the reservoir when pushed by the drive rod of the device component.

According to a third aspect of some embodiments described herein, there is provided a method for dispensing aerosol generating material from a reservoir in an aerosol provision system; the method comprising: advancing a drive rod in a pushing direction at a first speed to approach a movable plunger for displacing aerosol generating material through an outlet of a reservoir for storing aerosol generating material, from a spacing of the drive rod from the plunger that exceeds a predetermined spacing of the drive rod from the plunger; monitoring the spacing of the drive rod from the plunger during the advancing at the first speed; ceasing the advancing at the first speed when the monitoring indicates that the spacing is substantially equal to or less than the predetermined spacing; and subsequently, when aerosol generating material is required to be displaced from the reservoir, advancing the drive rod against the plunger to push the plunger to displace aerosol generating material through the outlet, at a second speed which is slower than the first speed.

According to a fourth aspect of some embodiments described herein, there is provided a device component for an aerosol provision system, the device component comprising: a drive rod for pushing against a movable plunger in order to displace aerosol generating material through an outlet of a reservoir for storing aerosol generating material; a drive assembly operable to advance the drive rod in a pushing direction, at a first speed to approach the plunger and at a second speed when against the plunger to move the plunger in order to displace aerosol generating material, the first speed being faster than the second speed; and a controller configured to operate the drive assembly to advance the drive rod at the first speed from a spacing of the drive rod from the plunger that exceeds a predetermined spacing, and to cease advancing the drive rod at the first speed when the spacing of the drive rod from the plunger is substantially equal to the predetermined spacing; and operate the drive assembly to advance the drive rod at the second speed to move the plunger to displace aerosol generating material when aerosol generating material is required.

According to a fifth aspect of some embodiments described herein, there is provided a method for dispensing aerosol generating material from a reservoir in an aerosol provision system; the method comprising: advancing a drive rod in a pushing direction at a first speed to approach a movable plunger for displacing aerosol generating material through an outlet of a reservoir for storing aerosol generating material, from a spacing of the drive rod from the plunger that exceeds a predetermined spacing of the drive rod from the plunger; ceasing the advancing at the first speed when the spacing of the drive rod from the plunger is substantially equal to the predetermined spacing; and subsequently, when aerosol generating material is required to be displaced from the reservoir, advancing the drive rod against the plunger to push the plunger to displace aerosol generating material through the outlet, at a second speed which is slower than the first speed.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, an aerosol provision system, a device therefor, or a method of operating the device may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which.

DETAILED DESCRIPTION

Figure 1:
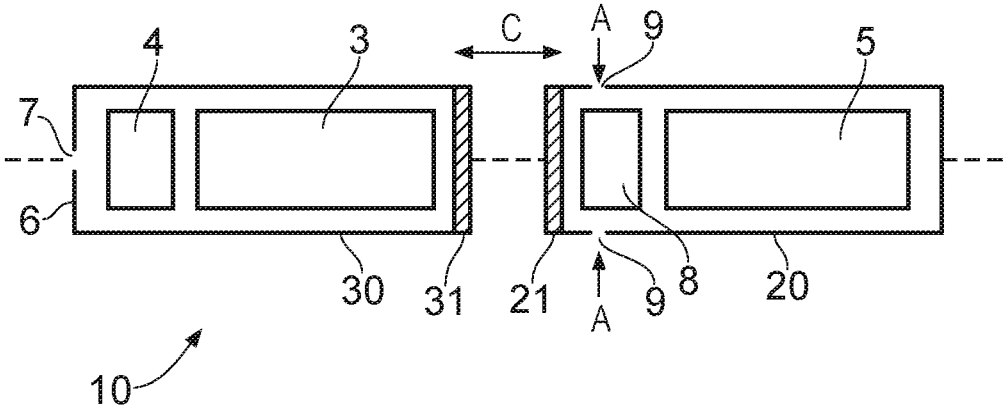
FIG. 1 shows a simplified schematic cross-sectional view of an example aerosol provision system to illustrate typical components in such a system.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus discussed herein which are not described in detail may be implemented in accordance with any conventional techniques for implementing such aspects and features.

As described above, the present disclosure relates to (but is not limited to) aerosol or vapor provision systems, also referred to as delivery systems or simply systems, such as e-cigarettes. Throughout the following description the terms "e-cigarette" and "electronic cigarette" may sometimes be used; however, it will be appreciated these terms may be used interchangeably with aerosol (vapor) provision or delivery system. In particular, the systems can be considered to be non-combustible aerosol provision systems, that release compounds from an aerosol-generating material (aerosolizable material) without combusting the aerosol-generating material, such as electronic cigarettes and hybrid systems. Such systems are intended to generate an inhalable aerosol by vaporization of an aerosol-generating material in the form of a liquid or gel which may or may not contain nicotine. Additionally, hybrid systems may comprise a liquid or gel material plus a solid substrate which is heated. The solid substrate may be for example tobacco or other non-tobacco products, which may or may not contain nicotine. The terms "aerosolizable material" and "aerosol-generating material" as used herein are intended to refer to materials which can form an aerosol, either through the application of heat or some other means. The term "aerosol" may be used interchangeably with "vapor".

According to the present disclosure, a "non-combustible" aerosol provision system is one where a constituent aerosol-generating material in the aerosol provision system (or a component thereof) is not combusted or burned in order to facilitate delivery of at least one substance to a user. In some embodiments, the delivery system is a non-combustible aerosol provision system, such as a powered or electronic non-combustible aerosol provision system. In some embodiments, the non-combustible aerosol provision system is an electronic cigarette, also known as a vaping device or electronic nicotine delivery system (END), although it is noted that the presence of nicotine in the aerosol-generating material is not a requirement. In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product. Typically, the non-combustible aerosol provision system may comprise a non-combustible aerosol provision device and a consumable for use with the non-combustible aerosol provision device. In some embodiments, the disclosure relates to consumables comprising aerosol-generating material and configured to be used with non-combustible aerosol provision devices. These consumables are sometimes referred to as articles throughout the disclosure. In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source. In some embodiments, the non-combustible aerosol provision system may comprise an area for receiving the consumable, an aerosol generator, an aerosol generation area, a housing, a mouthpiece, a filter and/or an aerosol-modifying agent. In some embodiments, a consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

Aerosol-generating material (or aerosolizable material) is a material that is capable of generating aerosol, for example when heated, irradiated or energized in any other way. Aerosol-generating material may, for example, be in the form of a solid, liquid or gel which may or may not contain an active substance and/or flavorants. Embodiments of the disclosure are particularly concerned with aerosol-generating material in the form of a liquid or a gel. The aerosol-generating material may comprise one or more active substances and/or flavors, one or more aerosol-former materials, and optionally one or more other functional materials. The aerosol-former material may comprise one or more constituents capable of forming an aerosol. In some embodiments, the aerosol-former material may comprise one or more of glycerin, glycerol, propylene glycol, diethylene glycol, triethylene glycol, tetraethylene glycol, 1,3-butylene glycol, erythritol, meso-erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. The one or more other functional materials may comprise one or more of pH regulators, coloring agents, preservatives, binders, fillers, stabilizers, and/or antioxidants.

Herein, a consumable is an article (component of an aerosol provision system) comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

FIG. 1 is a highly schematic diagram (not to scale) of a generic example aerosol provision system 10 such as an e-cigarette, presented for the purpose of showing the relationship between various parts of a typical system and explaining the general principles of operation. Note that the present disclosure is not limited to a system configured in this way, and features may be modified in accordance with the various alternatives and definitions described herein and/or apparent to the skilled person. The e-cigarette 10 has a generally elongate shape in this example, extending along a longitudinal axis indicated by a dashed line, and comprises two main components, namely a device 20 (control or power component, section or unit), and an article or consumable 30 (cartridge assembly or section, sometimes referred to as a cartomizer or clearomizer) carrying aerosol-generating material and operating as a vapor-generating component.

The article 30 includes a reservoir 3 containing a source liquid or other aerosol-generating material comprising a formulation such as liquid or gel from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated), such as a portion of tobacco or other flavor element through which vapor generated from the liquid is passed, may also be included. The reservoir 3 has the form of a storage tank, being a container or receptacle in which source liquid can be stored such that the liquid is free to move and flow within the confines of the tank. For a consumable article, the reservoir 3 may be sealed or otherwise made inaccessible after filling during manufacture so as to be disposable after the source liquid is consumed; otherwise, it may have an inlet port or other opening through which new source liquid can be added by the user. The article 30 also comprises an aerosol generating component or aerosol generator 4, for example an electrically powered heating element or heater located externally of the reservoir tank 3 for generating the aerosol by vaporization of the source liquid by heating. A liquid transfer or delivery arrangement (liquid transport element or more generally an aerosol-generating material transfer component) such as a wick or other porous element (not shown) may be provided to deliver source liquid from the reservoir 3 to the aerosol generator 4. A wick may have one or more parts located inside the reservoir 3, or otherwise be in fluid communication with the liquid in the reservoir 3, so as to be able to absorb source liquid and transfer it by wicking or capillary action to other parts of the wick that are adjacent to or in contact with the aerosol generator 4. In other arrangements, liquid may be dispensed from the reservoir 3 directly onto, or into the vicinity of, the aerosol generator 4. The liquid delivered to the aerosol generator is then vaporized by action of the aerosol generator, for example by heating if the aerosol generator is a heater or heating element, to be replaced by new source liquid from the reservoir 3 for transfer to the heater 4.

A heater and wick (or other aerosol-generating material transfer component) combination is sometimes referred to as an atomizer or atomizer assembly, and the reservoir with its source liquid plus the atomizer may be collectively referred to as an aerosol source. Various designs are possible, in which the parts may be differently arranged compared with the highly schematic representation of FIG. 1. For example, a material transfer component may be porous and be an entirely separate element from the heater, or the heater itself may be configured to be porous and able to perform at least part of the wicking function directly (a metallic mesh, for example). In an electrical or electronic device, the aerosol generator may be an electrical heating element that operates by ohmic/resistive (Joule) heating or by inductive heating. In general, therefore, an atomizer can be considered as one or more elements that implement the functionality of an aerosol generator or vaporizing element able to generate vapor from source liquid delivered to it, and a liquid transport or delivery element or arrangement able to deliver or transport liquid from a reservoir or similar liquid store to the aerosol generator. An atomizer is typically housed in an article 30 of an aerosol provision system, as in FIG. 1, but in some examples, at least the aerosol generator may be housed in the device 20. As mentioned, in some designs liquid may be dispensed from a reservoir directly onto an aerosol generator with no need for a distinct wicking or capillary element. Embodiments of the disclosure are applicable to all and any such configurations which are consistent with the examples and description herein.

Returning to FIG. 1, the article 30 also includes a mouthpiece or mouthpiece portion 6 having an opening or air outlet 7 through which a user may inhale the aerosol generated by the aerosol generator 4.

The device 20 includes a cell or battery 5 (referred to herein after as a battery, and which may or may not be re-chargeable) to provide electrical power for electrical components of the system 10, in particular to operate the aerosol generator. Additionally, there is a controller 8 such as a printed circuit board and/or other electronics or circuitry for generally controlling the system 10. The controller 8 may include a processor programmed with software, which may be modifiable by a user of the system 10. The control electronics/circuitry 8 operates the aerosol generator 4 using power from the battery 5 when vapor is required. At this time, the user inhales on the system 10 via the mouthpiece 6, and air A enters through one or more air inlets 9 in the wall of the device 20 (air inlets may alternatively or additionally be located in the article 30). When the aerosol generator 4 is operated, it vaporizes source liquid delivered from the reservoir 3 to generate the aerosol by entrainment of the vapor into the air flowing through the system 10, and this is then inhaled by the user through the opening 7 in the mouthpiece 6. The aerosol is carried from the aerosol generator 4 to the mouthpiece 6 along one or more air channels (not shown) that connect the air inlets 9 to the aerosol generator 4 to the air outlet 7 when a user inhales on the mouthpiece 6.

The device 20 and the article 30 are separate connectable parts detachable from one another by separation in a direction parallel to the longitudinal axis, as indicated by the arrow C in FIG. 1. The components 20, 30 are joined together when the system 10 is in use by cooperating coupling or connecting elements 21, 31 (for example, a screw or bayonet fitting) which provide mechanical and in some cases electrical connectivity between the device 20 and the article 30. Electrical connectivity is required if the aerosol generator 4 is a heater operable by ohmic heating, so that current can be passed through the aerosol generator 4 when it is connected to the battery 5. In systems that use inductive heating, electrical connectivity can be omitted if no parts requiring electrical power are located in the article 30. An inductive work coil can be housed in the device 20 and supplied with power from the battery 5, and the article 30 and the device 20 shaped so that when they are connected, there is an appropriate exposure of aerosol generator 4, in the form of an inductive susceptor, to flux generated by the coil for the purpose of generating current flow in the material of the aerosol generator. Other electrically powered examples of aerosol generators include a vibrating mesh that expels droplets of liquid, for example operating via the piezoelectric effect. The FIG. 1 design is merely an example arrangement, and the various parts and features may be differently distributed between the device 20 and the article 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. Embodiments and examples of the present disclosure are applicable to any of these configurations and other configurations of which the skilled person will be aware.

Some designs of aerosol provision system have a reservoir arrangement in the consumable component from which non-solid aerosol-generating material is dispensed by being forced out of an outlet in the reservoir wall. This is achieved by configuring the reservoir to have a movable wall that can slide under the application of a pushing force in an inwards direction to reduce the internal volume of the reservoir where the material is stored. The reduction in volume increases the pressure on the material in the reservoir, and an amount of material leaves the reservoir via the outlet in order to reduce the pressure to an equilibrium level. The pushing force is applied by a push applicator that acts on the movable wall on an exterior side, opposite to an interior side that faces into the internal volume of the reservoir. The push applicator, which may take a variety of forms, is accommodated in the device component, and operable to provide the pushing force to the movable wall when the device component and the consumable component are coupled, engaged or connected together to form the aerosol provision system.

A reservoir arrangement of this type can provide some benefits as compared to a fixed volume reservoir which develops a volume of air (headspace) inside as the aerosol generating material is consumed. Leakage can be reduced, since a headspace can change volume due to changes in ambient pressure or temperature, thereby pushing material from the reservoir at unwanted times. Requirements for viscosity of the aerosol generating material are relaxed; the material does not need to flow, merely be able to be displaced. The system is made independent of orientation since there is no reliance on gravity for the flow of liquid out of the reservoir. Rather, the material is pushed out of the reservoir on demand, by operation of the push applicator at appropriate times, so the system can be used upside down for an extended period, such as if the user is reclining. Similarly, the absence of any gravitational feed also increases the options for the relative orientation of the reservoir and the aerosol generator.

Figure 2:
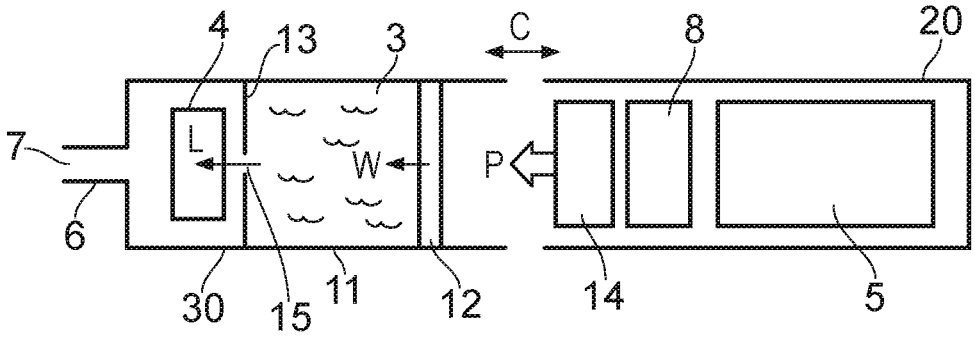
FIG. 2 shows a simplified schematic cross-sectional view of an example aerosol provision system having a consumable with a reducible volume reservoir, to which examples of the disclosure may be applied.

FIG. 2 shows a simplified schematic depiction of an example of an aerosol provision system of this type. As in the FIG. 1 example, the system comprises a device 20 and a consumable 30, configured to be connected together in a longitudinal arrangement indicated by the arrow C. The device 20 and the consumable 30 are depicted in a uncoupled configuration to better illustrate the division of parts between the components.

The consumable 30 has an outer wall 11, which might have a cylindrical transverse cross-section, which defines within it a space of which part acts as a reservoir 3 for storing aerosol generating material in an internal volume. This volume is also bounded by a fixed wall 13 which extends transversely across the space inside the outer wall 11 at a position towards the mouthpiece end 6 of the consumable 30, and by a movable wall 12 which also extends transversely across the space inside the outer wall 11, at a position proximate to the connecting end of the consumable. The space between the fixed wall 13 and the movable wall 12 is the reservoir 3. The fixed wall 13 has an outlet 15 therein through which aerosol generating material stored in the reservoir 3 can be dispensed, indicated by the arrow L. The dispensed material is delivered to an aerosol generator 4, located in an aerosol generating space or cavity between the fixed wall 13 and the mouthpiece 6, that acts on the material to generate a vapor in any known manner, such as by heating. The aerosol-generating material L can be dispensed directly onto the aerosol generator 4, or into the vicinity of the aerosol generator in a region into which the action of the aerosol generator 4 extends, or onto or into some form of aerosol generating material transport element such as a wick or porous element or capillary tube that carries material from the outlet 15 to or near the aerosol generator 4.

The movable wall 12 is not fixed and is configured to be able to move or slide over the inner surface of the outer wall 11 in an inwards direction, that is, towards the fixed wall 13. This movement reduces the internal volume of the reservoir 3, increases the pressure in the aerosol-generating material, and causes a portion of the material to be displaced through the outlet 15. A suitable sealing arrangement is provided around the perimeter of the movable wall 12 in order to reduce or prevent leakage of the aerosol-generating material through the junction between the moveable wall 12 and the outer wall 11, thereby providing an effectively water-tight internal storage volume except for the outlet 15. A rubber or silicone gasket might be suitable, for example, or the moveable wall 12 itself may be formed from a flexible resilient material of this type. This inward movement of the moveable wall, indicated by the arrow W, is effected by a pushing force applied to the outer surface of the moveable wall 12, that is, the surface that does not face towards the reservoir interior. The pushing force acts substantially perpendicularly to the plane of the movable wall (which in this example is flat, but need not be), along the desired inward direction of movement W.

Accordingly, the delivery of aerosol-generating material from the reservoir 3 can be considered analogously to the ejection of liquid from a syringe, where the outer wall 11 of the consumable 30 corresponds to the barrel of the syringe, and the movable wall 12 corresponds to the plunger of the syringe. In the following, the term "plunger" may be used to refer to the movable wall 12.

Note that a reservoir with a reducible volume effected by a movable wall need not be configured as shown in FIG. 2. For example, dedicated boundary walls may be provided to define the sides of the reservoir, so that the reservoir is mounted inside the outer wall of the consumable and does not share walls with it. The outlet may be located differently, for example it need not be centrally located within the fixed end wall, but might be to one side of this position. If the reservoir has its own side walls lying inside the consumable outer wall, the outlet might be in the side wall rather than the fixed end wall. This may be better suited to some configurations of aerosol generator, but an outlet in the fixed end wall may be advantageous as better enabling the complete ejection of all material from the reservoir, by movement of the movable wall along the full extent of the reservoir and into contact with the fixed wall, thereby reducing the internal storage volume to substantially zero. For configurations with dedicated reservoir boundary walls, the reservoir might be separately replaceable when empty. In this case, the reservoir can be considered as the consumable or consumable article, and the aerosol generator and mouthpiece can be comprised within the device. Alternatively, the reservoir might a consumable article that can be replaced into the larger consumable 30 which can in turn be replaced onto the device to form the system. Examples of the present disclosure are generally applicable to configurations in which the reservoir can be removed and replaced with respect to the device, regardless of the nature and amount of other parts which are replaceable in a same housing with the reservoir.

The device 20 comprises a battery 5 and a controller or control electronics 8 as before. Additionally, the device comprises a push applicator 14, being a device, apparatus, means or other arrangement operable to provide and apply the required pushing force P to the movable wall 12, when the device 20 is engaged with the consumable 30. The push applicator 14 can be operable under the control of the controller 8 to provide an amount of pushing force P necessary to dispense a required volume or portion of material from the reservoir at an appropriate time. Typically this will be when a user requires aerosol provision, in other words, wishes to inhale or "puff" on the system. At the same time or very shortly thereafter, the aerosol generator 4 is also activated, by the controller 8, in order to vaporize the dispensed portion of material. The push applicator 14 and the aerosol generator 4 can be activated by the controller 8 in response to user actuation of an input control element on the exterior of the system, such as a button or switch (not shown), or in response to a flow of air through the system detected by an air flow sensor or air pressure sensor (puff detector, also not shown) when the user begins to inhale via the mouthpiece 6. The push applicator 14 may be activated for a pre-set amount of time configured to dispense a predetermined volume of material, such as an amount generally corresponding to the amount of vapor consumed in an average puff, or it may be activated for the duration of the puff, in other words until the end of the puff as detected by the cessation of user activation of the input control element or the cessation of air flow, or for some other time, or to provide a predetermined amount of force. The push applicator 14 may take a variety of forms.

Figure 3:
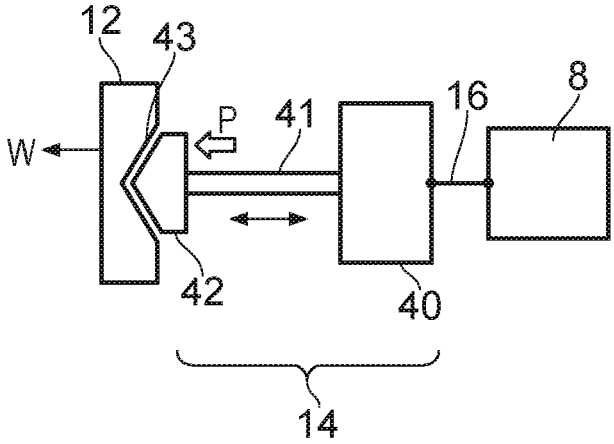
FIG. 3 shows a simplified side view of an example push applicator operable to move a plunger in a reducible volume reservoir such as that of the consumable of the FIG. 2 example system.

FIG. 3 shows a simplified schematic side view of an example push applicator 14, acting on a plunger 12. The push applicator 14 is a mechanical device comprising a drive rod 41 operable to advance in the required direction of the pushing force P (a pushing direction, towards the plunger 12) and press or push against the exterior surface of the plunger 12 in order to move it inwardly in the direction W. The rod 41 is moved by a suitable mechanical drive mechanism. Examples of these will be apparent to the skilled person, such as a worm drive, in which the rod 41 may be the worm screw or may be coupled to the worm screw, or the rod 41 taking the form of a lead screw or being coupled to a lead screw. Movement is provided by a motor in a drive assembly 40 to which the rod 41 coupled. The driver unit 40 is operated, under electrical power from the battery in the device, to move the rod 41 when required in response to control signals 16 from the controller 8. In particular, the drive assembly 40 is operable to advance the drive rod in the pushing direction, to approach and then contact the plunger 12. In this example, the rod 41 terminates at its distal end, remote from the driver unit 40, in a shaped engagement member 42 that comes into contact with the exterior surface of the plunger 12. The engagement member 42 may, for example, be made from a resilient material such as rubber, silicone or a plastics material, in order to absorb the impact when the rod 41 is first engaged against the plunger 12 and minimize shock waves and pressure disturbance inside the reservoir. In the depicted example, the engagement member 42 has a greater width than the rod 41; this provides a large contact area with the plunger 12 while reducing material and weight for the rod 41, saving cost and reducing the power needed to drive the rod 41. However, the engagement member 42 and the rod 41 may have the same width. In order to assist with engagement of the rod 41 with the plunger 12, the engagement member may be shaped in a complementary manner to a shaping 43 provided on the exterior surface of the plunger 12. In this example, the plunger has a concavity 43 in its exterior surface, and the engagement member 42 is convex and shaped to fit into the concavity 43. Other shapings may be used, including a convex plunger surface and a concave rod end. Shaping for the plunger 12 may be formed directly in or on the plunger 12, or may be provided in a shaped member (not shown) that is mounted onto the exterior surface of the plunger 12. Such a shaped member may be formed from resilient material in addition to or instead of the engagement member.

In use, the drive rod 41 has an initial retracted position in which it is housed wholly or largely within the device 20. After the device 20 is connected to the consumable 30, the drive assembly 40 acts to advance the rod 41 in the pushing direction to make contact with the plunger 12, or to be in close proximity thereto. The rod 41 is therefore located in a position for it to pushing against the plunger 12 in order to enable rapid dispensing from the reservoir when aerosol generating material is needed. This initial advancement may be made in response to detection of the consumable 30 being connected to the device 20 by a detector (not shown) when sends a detection signal to the controller 8. Then, each time aerosol is required, the controller 8 activates the drive assembly to operate the rod 41 such that it advances an appropriate distance, thereby applying the pushing force P against the plunger 12 in order to move it inwardly W. After each puff, the rod 41 may maintain its current position against or in contact with the plunger 12, ready for further advancement when the next puff is demanded. Once the reservoir has been emptied, which might be detected by detection of a maximum extension or advancement of the rod 41 from the driver unit 40 for example, the drive assembly 40 can operate in reverse to retract the rod 41 to its initial position within the device 20. This will enable the consumable 30 to be disconnected from the device 20 for replacement.

In some systems, it may further be possible to separate the consumable from the device before it is completely empty, and reinstall it at a later time for consumption of the remaining aerosol generating material. This allows the user to switch between different types of aerosol generating material, such as changing flavor, without having to wait until the reservoir is empty or throwing away an only partially-consumed consumable. Also, it may be that consumables are provided with different volumes of aerosol generating material therein, such as smaller sample quantities of material to allow the user to test different types. In these various circumstances, the position of the plunger is not fixed across all consumables that might possibly be connected to the device. Consequently, it is not feasible, when a consumable is connected to the device, for the controller merely to cause the drive rod to be advanced by a set distance in order for it to be located for pushing against the plunger.

Instead, the drive rod should be advanced until it is properly located for pushing against the plunger, regardless of the plunger position and hence the spacing between the end of the drive rod and the plunger when the consumable and the device are coupled together. The amount of initial advancement required prior to dispensing is therefore variable. Subsequent incremental advancement of the drive rod for pushing the plunger and dispensing aerosol substrate material may be a fixed distance each time, corresponding to a fixed dose of material, and is typically carried out at a relatively low speed, since the distances to be covered are small, and in order to achieve smooth dispensing and avoid jerky movement of the plunger.

If this same speed is used to move the drive rod during the initial advancement, it may take an unacceptably long time for the system to be placed into an operational state, ready for aerosol generation. This is particularly the case for a near-empty reservoir, when the spacing between the drive rod and the plunger is large. Accordingly, it is proposed that the drive assembly be configured to advance the drive rod at more than one speed, under direction from the controller. A first speed is enabled, for moving the drive rod from its initial retracted position towards the plunger and into position for pushing against the plunger. A second speed is also enabled, for moving the drive rod when it is contact with the plunger in order to push the plunger inwards and dispense material from the reservoir. The first speed is faster (higher, greater, larger) than the second speed. Conversely, the second speed is slower (lower, less, smaller) than the first speed. The provision of multiple drive speeds enables the system can be rendered operable more rapidly when the consumable is connected to the device.

However, recall that the position of the plunger is variable, and unknown to the controller. It is undesirable to continue movement of the drive rod at the first speed once it is in contact with the plunger, since this will reduce the reservoir volume very quickly and cause unwanted quantities of aerosol generating material to be dispensed. Accordingly, it is also proposed that the proximity of the drive rod to the plunger be monitored, measured or detected while the drive rod is approaching the plunger at the first speed, and when the proximity (spacing between the drive rod and the plunger) is detected to have decreased to a predetermined spacing, the drive assembly ceases operation at the first speed. Upon detection of the predetermined spacing, the drive assembly can switch to the second speed, or switch to another speed which is slower than the first speed, or halt the advancement of the drive rod. The predetermined spacing may be a positive value, at which the drive rod is separated from the plunger, or the predetermined spacing may be zero, at which the drive rod is in contact with the plunger. In this way, the drive rod can be moved at an appropriate speed according to its separation from or contact with the plunger, for any plunger position, and avoiding unwanted rapid pushing of the plunger.

We can define a range of variables to describe the different combinations of positions and speeds. These are indicated on and described with respect to the following highly schematic diagrams.

Figure 4A:
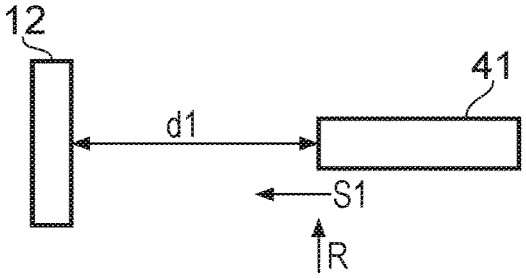
FIGS. 4A-4F show simplified schematic representations of a push applicator drive rod and a plunger in various positions to illustrate parameters of interest in example techniques for driving the drive rod according to the present disclosure.

FIG. 4A shows a schematic representation of a drive rod 41 and plunger 12. These two elements are in initial positions arising when the consumable comprising the reservoir and hence the plunger 12 is connected to the device comprising the drive rod 12 41. The end of the drive rod 41 proximate the plunger 12, and which will be engaged with the plunger 12 in order to push it, is at an initial, retracted, position R, at a spacing d1 from the exterior surface of the plunger 12. The drive rod 41 will be advanced towards the plunger 12, and therefore moved along the pushing direction, at the first speed S1. The retracted position R, from which movement at the first speed S1 is effected, is at a spacing or separation from the plunger that is greater than the predetermined spacing mentioned above.

Figure 4B:
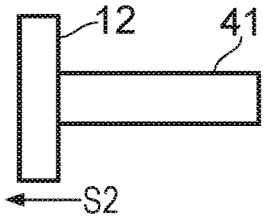

FIG. 4B shows the drive rod 41 and the plunger 12 after the drive rod 41 has covered the distance d1 so that its end is in contact with the plunger 12 and able to push it along the pushing direction. To effect the pushing, the drive rod is moved at the second speed S2, which is slower than the first speed S1. In order to get the drive rod 41 from its retracted position R to engagement against the plunger 12, proximity sensing is used as mentioned above. The distance d1 can be covered in one or more movement stages, according to the followed examples.

Figure 4C:
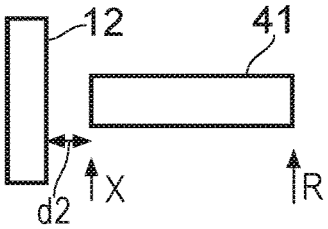

FIG. 4C shows the drive rod 41 and the plunger 12 in positions attained according to a first example. The drive rod 41 has been advanced at the first speed S1 from the retracted position R to a position X at which the spacing between the end of the drive rod 41 and the plunger 12 is a predetermined spacing d2 considered to correspond to proximity of the drive rod 41 to the plunger 12. When the drive rod 41 reaches the proximity position X, movement of the drive rod 41, as controlled by the controller, is stopped. As noted above, the proximity position X may be set such that the predetermined spacing d2 has a positive value, in other words, there is still some distance separating the end of the drive rod 41 from the plunger 12, as shown in FIG. 4C.

Figure 4D:
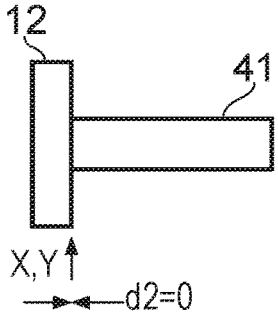

FIG. 4D shows the drive rod 41 and the plunger 12 positioned according a second example. In this case, the proximity position X is set to be coincident with the exterior surface of the plunger 12, so that the drive rod 41 is in contact with the plunger 12. In other words, the predetermined spacing d2 is substantially equal to zero. So, in this case, the drive rod 41 is advanced at the first speed S1 until it comes into contact with the plunger 12, at which point driving at S1 ceases. FIG. 4D also indicates a further parameter Y, which is a position of the end of the drive rod 41 considered to be a position at which the drive rod 41 is located for pushing against the plunger 12. This is defined at the position occupied by the drive rod 41 prior to commencement of a pushing action during which it is driven at the slower speed S2 to move the plunger 12 and dispense material from the reservoir. In this example, the positions Y and X are coincident. The faster speed S1 is used to move the drive rod 41 until it is in contact with the plunger 12. From this position, when aerosol generation is required, the drive rod 41 can be driven at the slower speed S2 to push against the plunger 12 immediately when the slower movement starts.

Referring back to FIG. 4C, a third example is to again define X and Y to be coincident, but with the positive non-zero value of the predetermined spacing d2 shown in FIG. 4C. Hence, in this example, the drive rod 41 is located for pushing, in position Y, at a position which is spaced from the plunger 12. In order to effect pushing of the plunger when aerosol generation is required, the drive rod 41 can then be advanced from position Y at the second speed S2 until it comes into contact with the plunger 12 and then advanced further at the second speed S2 in order to move the plunger 12. While this arrangement takes a little longer to dispense aerosol generating material from the reservoir owing to the time required from the drive rod 41 to cover the distance d2 and come into contact with the plunger 12, it may be advantageous over the second example since it avoids the drive rod 41 impacting the plunger 12 at the higher first speed S1. Such an impact may cause unwanted movement of the plunger, or induce a pressure wave inside the reservoir, both being circumstances that could cause material to be ejected from the reservoir at an unwanted moment.

From these examples it will be appreciated that the position of the drive rod when it is deemed to be "located for pushing against the plunger" is defined so as to include the alternatives of being located in already in contact with the plunger so that movement of the drive rod immediately pushes the plunger, and being located slightly spaced apart from the plunger so that an initial movement is needed to contact the plunger before pushing begins. The latter arrangement may include a small retraction of the drive rod after each pushing action in order to reinstate the slight spacing; this can relieve pressure inside the reservoir and reduce the risk of accidental ejection of liquid that might arise from physical shocks or thermal expansion.

Figure 4E:
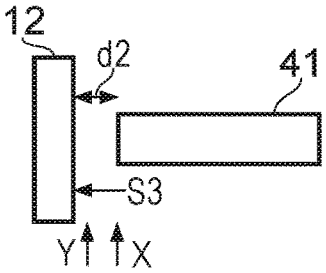

FIG. 4E shows the drive rod 41 and the plunger 12 positioned according to a fourth example. In this case, the position X of the drive rod when it reaches the predetermined spacing d2 is different from the position Y of the drive rod when it is located for pushing the plunger 12. The predetermined spacing d2, which when reached causes the drive rod movement at the first speed S1 to cease, is set to be greater than the spacing of the drive rod 41 from the plunger 12 when the drive rod is located for pushing at position Y. In other words, position X is spaced further from the plunger 12 than position Y. In order to operate according to this example, the drive rod 41 is advanced at the first speed S1 from its retracted position R to the predetermined spacing d2 at position X. Then, in order to locate the drive rod 41 ready for pushing when aerosol generation is desired, the drive rod is further advanced at a third speed S3 which is slower than the first speed S1.

Figure 4F:
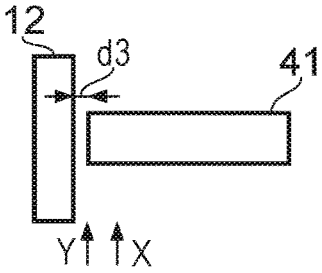

FIG. 4F shows the drive rod 41 and the plunger 12 after movement at the third speed S3, when the drive rod 41 has reached position Y, ready for pushing the plunger 12 when required for aerosol generation. Position Y is spaced from the plunger by a distance d3, which is less than the predetermined spacing d2. Then, when material dispensing for aerosol generation is needed, the drive rod 41 can be operated to advance and engage against the plunger 12 in order to push it at the second speed S2, as described with respect to FIGS. 3 and 4.

The third speed S3 used to move the drive rod 41 from the predetermined spacing into its final position Y ready for pushing can be slower than the first speed S1. In some examples it may be substantially the same as the second speed S2. In other examples it may be faster than S2. This contributes to the rapid positioning of the drive rod to place the system into an operable state while avoiding the use of the fastest drive speed when the drive rod is very close to the plunger. This can reduce the risk of accidental high speed impact of the drive rod with the plunger in the event of errors in the proximity detection. Alternatively, the third speed S3 may be slower than S2. This can allow more precise positioning of the drive rod into the pushing location Y. In summary, S1>S2 and S1>S3, where S2=S3 or S2>S3 or S2<S3.

In another example, the distance d3 can be selected to be zero. In other words, the drive rod is placed in contact with the plunger in order to be located ready for pushing, as in the FIG. 4 example. Hence, the drive rod is advanced at the first speed S1 to the predetermined spacing at position X, and then at the lesser third speed S3 to cover the distance d2 and come into contact with the plunger at position Y. It is maintained in this position until aerosol generation is required, and the drive rod is then operated to advance at the second speed S2 to move the plunger.

In examples in which the location for pushing, drive rod position Y, is spaced apart from the plunger (d3>0), the initial part of the pushing action in which the drive rod is advanced over the distance d3 to reach the plunger may be effected at the second speed S2, as noted above, or at the third speed S3, or at some other speed different from both the second speed S2 and the third speed S3 and also less than the first speed S1.

From the foregoing description it will be understood that in order to achieve the proposed multi- or dual-speed driving of the drive rod by the drive assembly, it is appropriate to detect the proximity of the drive rod to the plunger. In this context, the proximity is the spacing or distance between the drive rod and the plunger, or the separation of the drive rod from the plunger. If the proximity is detected while the drive rod is approaching the plunger at the first speed, it can be established when the drive rod reaches the predetermined spacing from the plunger by comparison of the detected proximity with the value of the predetermined spacing. When the predetermined spacing is reached, the advancement of the drive rod at the first speed is stopped.

This can be achieved by the use of a proximity detecting arrangement or proximity detector which monitors the spacing while the drive rod is being driven at the first speed by the drive assembly under control of the controller. The proximity detector can continuously or periodically output values of the measured proximity which are provided to the controller. The controller repeatedly compares the most recent value of the measured proximity with a stored value of the predetermined spacing. When the comparison determines that the measured proximity is substantially equal to the predetermined spacing, the controller stops operation of the drive assembly to move the drive rod at the first speed. This can be followed by the controller sending control signals to the drive assembly for any of various immediate or subsequent movements of the drive rod at the second speed, the third speed or another slower speed according to the various examples set out above.

Alternatively, the comparison may be carried out to look for a measured proximity that is slightly larger than the predetermined spacing, so that the controller instructs cessation of movement at the first speed before the predetermined spacing is reached. This can allow for processing time and the time required to bring the drive rod to a halt (inertial effects, for example), so that when the movement ceases, the drive rod has arrived at the predetermined spacing. This may be useful in examples where the predetermined spacing is substantially zero (FIG. 4D), to minimize impact of the drive rod into the plunger. In other cases it may be sufficient to treat the predetermined spacing as a threshold, and to stop advancement at the first speed when the comparison shows that the detected proximity is equal to or less than the predetermined spacing. This may be appropriate for periodic measurements of proximity, such that it is possible that no measurement exactly matches the stored value for the predetermined spacing. Alternatively, the predetermined spacing might be defined as a range of spacings, and the first speed driving is stopped when the value of the measured proximity first falls within the range.

To implement this, the device additionally comprises a proximity detector, configured to detect the spacing or distance between the drive rod and the plunger. This can be the distance between the end surface of the drive rod and the exterior surface of the plunger, as depicted in the FIG. 4 examples. Alternatively, depending on the nature and position of the proximity detector, the actual measured distance may be between some other part of the plunger and some other part of the drive rod. So long as the measurements are appropriately calibrated and the predetermined spacing is set with reference to the two end points of the measurable distance, the precise configuration is not important. Any form of proximity sensor can be employed, as will be apparent to the skilled person. Some examples will now be described, but the disclosure is not limited in this regard, and other forms of proximity sensor can be used if desired.

Figure 5:
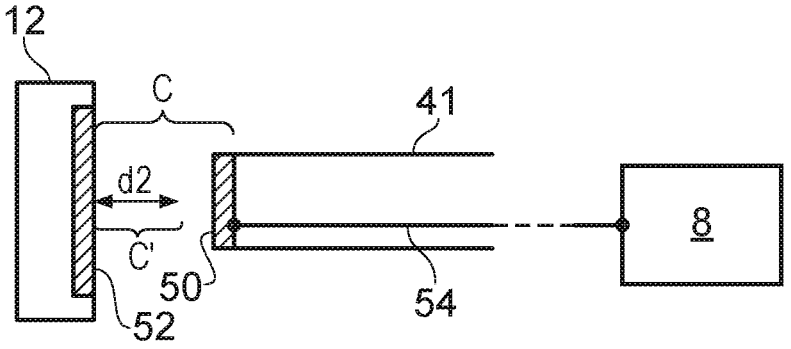
FIG. 5 shows a simplified schematic representation of a first example capacitive sensor for detecting proximity according to an example of the present disclosure.

FIG. 5 shows a schematic representation of a first example proximity detector that can be used to measure or detect the spacing of interest between the drive rod and the plunger. The proximity detector comprises a capacitive sensor, where capacitance measurement is a technology established for proximity detection. The capacitance between a pair of conductive or dielectric elements (capacitor plates) is monitored, and this varies with the separation between the elements, so that the value of the capacitance is directly related to the value of the spacing between the elements. In the FIG. 5 example, the capacitive sensor comprises a first capacitor plate 50 provided in or on the end face of the drive rod 41, for example by forming an end portion of the drive rod from a suitable material, or by providing the end surface of the drive rod with a coating of a suitable material, and an electrical connection 54 between the first plate 50 and the controller 8. A second capacitor plate 52 is provided in or on the exterior face of the plunger 12, again as a portion of suitable material secured to the plunger or as a surface coating. The electrical connection 54 is configured for the controller to apply a small voltage to the first capacitor plate 50 (by connection to the battery in the device) when proximity measurements are required, and to interrogate the capacitance C between the plates 50 and 52 as the drive rod is moved towards the plunger 12. The capacitance value C' that corresponds to the predetermined spacing d2 can be stored in memory in the controller 8, and a comparison made between the presently measured value of the capacitance C and the stored value C' in order to determine when the drive rod 41 has arrived at the predetermined spacing. Alternatively, the controller might be configured to convert the presently measured value of capacitance C into its corresponding spacing value, and compared the spacing value with a stored value of the predetermined spacing. The conversion might be by calculation according to a stored formula relating capacitance to spacing, or by reference to a look-up table, for example.

The capacitor plates may be differently configured if desired. For example, the plunger 12 may itself be made from a suitable conductive or dielectric material. Alternatively a portion of a suitable material might be embedded within the plunger, or provided on the interior surface of the plunger, where a coating of a suitable material might also be used. These arrangements can be used if the plunger is made from a non-conductive material unsuited for use as a capacitor plate, and may be useful in protecting the second capacitor plate 52 from damage when the drive rod 41 impacts the plunger 12. For similar reasons, the first capacitor plate 50 might be embedded behind the end surface of the drive rod 41, or provided with a non-conductive protective coating.

Figure 6:
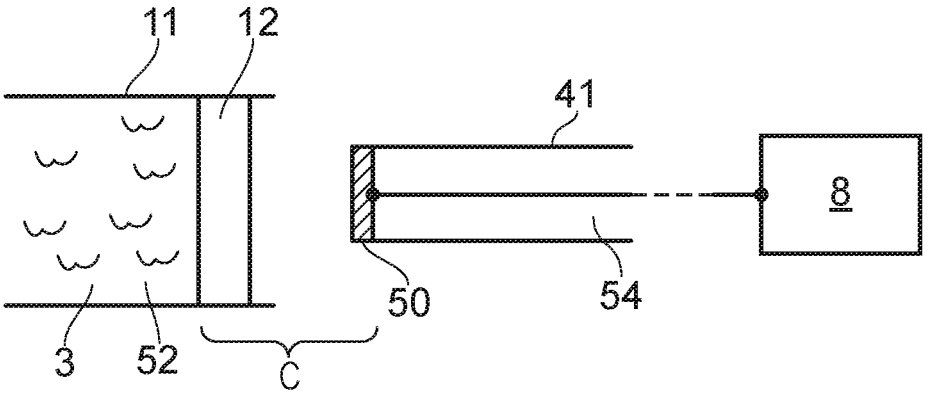
FIG. 6 shows a simplified schematic representation of a second example capacitive sensor for detecting proximity according to an example of the present disclosure.

FIG. 6 shows a schematic representation of a second example proximity detector that uses capacitance sensing. In this example, the first capacitor plate 50 is provided in, on or otherwise associated with the drive rod 41, as in the FIG. 5 example. The other element that acts as the second capacitor plate 52 is the aerosol generating material stored in the reservoir 3. Thus, the capacitance C is measured between the first capacitor plate 50 and the end surface or end portion of the aerosol generating material in the reservoir 3 immediately behind the plunger 12. The plunger 12 should be made from a non-conductive material, or at least a material which is substantially less conductive/dielectric than the aerosol generating material so that it is effectively invisible to the capacitance measurement.

Figure 7:
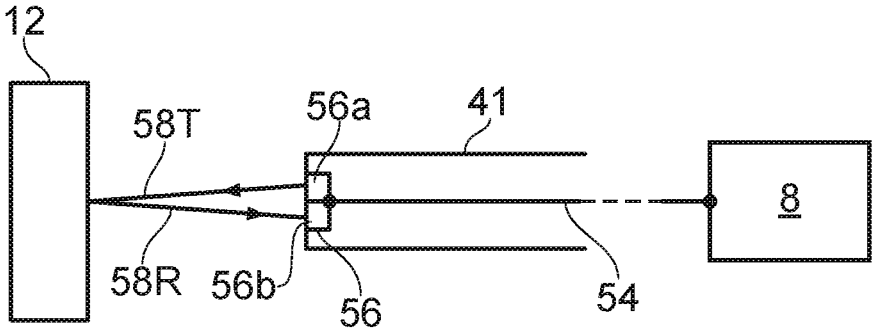
FIG. 7 shows a simplified schematic representation of an example time of flight sensor for detecting proximity according to an example of the present disclosure.

FIG. 7 shows a schematic representation of a third example proximity detector. The detector in that case comprises a time-of-flight detector. A transmitter/receiver or an emitter/detector sensor or module 56 is mounted on or in the end face of the drive rod 41, or alternatively on a side surface of the drive rod 41 facing towards the plunger 12. The sensor 56 comprises a transmitter/emitter 56*a* configured to transmit a pulse of light (or other electromagnetic energy such as a radio wave) or sound 58T towards the plunger 12. The sensor 56 is under the control of the controller 8 via a connection 54, to be triggered to emit pulses at known emission times when proximity detection is required. At least a portion of the energy in the transmitted pulse 58T is reflected from, or bounces off the surface of, the plunger 12 to provide a return portion 58R, which is detected by a receiver/detector 56*b* in the device 56. The time of detection is noted, and the duration of the round trip for the pulse (to the plunger and back again) is calculated from the emission time and the detection time—this is the time of flight. Since the transmission speed of the pulse is known (since the speeds of sound and of electromagnetic radiation are fixed), the distance the pulse has travelled can be calculated. From this, the proximity between the drive rod 41 and the plunger 12 can be calculated, as being half the round trip distance. These calculations can be performed in the sensor 56 so that a signal representing the currently measured value of the proximity can be sent to the controller 8 via the connection 54. Alternatively, and more conveniently, the sensor 56 can simply communicate to the controller 8 that the pulse has been detected, and the calculations can be performed in the controller 8. The detected proximity can be compared with a predetermined spacing stored in memory at the controller 8 in order to determine when the drive rod 41 has reached the position corresponding to the predetermined spacing so that movement at the first speed can cease. In an alternative, a pulse round trip time (time of flight) corresponding to the predetermined spacing can be stored in memory and compared to the measured round trip time in order to identify arrival at the predetermined spacing.

A time of flight proximity detector may also be implemented by placing the sensor 56 on the plunger and reflecting the pulses off the advancing drive rod, or by placing one of the transmitter or the receiver on the drive rod and the other of the transmitter or the receiver on the plunger (so that the pulse travels across the spacing for direct detection, rather than undergoing reflection and a round trip). However, these arrangements may be more complex to implement since electrical connectivity to the parts in the consumable is needed.

Proximity sensors such as a capacitive sensor or a time-of-flight sensor can be used to continuously monitor the spacing between the drive rod and the plunger, and are able to provide measurements that allow a positive predetermined spacing to be monitored, in other words, a predetermined spacing in which the drive rod is separated from the plunger. A predetermined spacing of zero, where the drive rod is in contact with the plunger, can also be detected, at least by looking for a sudden change in the measured response that results from contact being made. For example, for time of flight detection, the return pulse will become undetectable when the drive rod abuts the plunger, so the signal detected by the time of flight sensor will suddenly drop to zero. A similar sudden change in capacitance will occur if the two capacitor plates in a capacitive sensor make contact, since the capacitive ability is lost and the capacitance will drop to zero. Alternatively, if at least one of plates is located away from the abutting surfaces of the drive rod and the plunger (for example if the aerosol generating material in the reservoir is used as the second capacitor plate), a detectable capacitance will be maintained even when the drive rod impacts the plunger.

Further alternative arrangements are able to detect a zero predetermined spacing, that is, when contact is made by the drive rod onto the plunger, by implementing proximity detection based on the operation of an electric motor comprised in the drive assembly.

Figure 8:
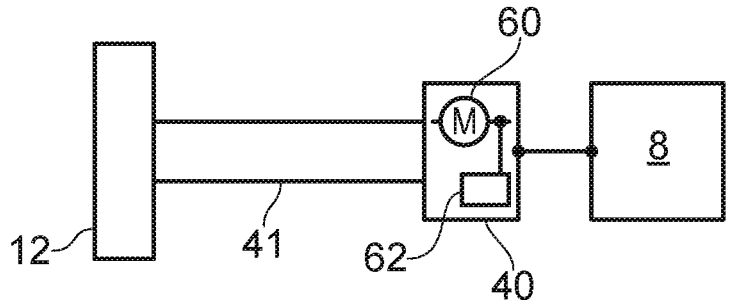
FIG. 8 shows a simplified schematic representation of an example arrangement for monitoring motor operation in order to detect proximity according to an example of the present disclosure.

FIG. 8 shows a simplified schematic representation of a proximity sensing arrangement that relies on monitoring a motor. The drive assembly 40 includes a motor 60 operable in response to control signals from the controller 8 to advance and retract the drive rod 41 at the various speeds described above. The drive assembly 40 also includes a detector 62 which acts as a proximity detector in that it is configured to detect a condition indicating contact being made by the advancing drive rod 41 against the plunger 12. Detection of the condition can be fed to the controller 8, which in response acts to cease movement of the drive rod 41 at the first speed.

When the drive rod makes contact with the plunger, the load on the motor will increase. More force is required to make the drive rod continue to advance, since it is now pushing against the plunger. The motor now has to work to move both the drive rod and the plunger. The increased load will cause the motor to drawn more current from the device's battery. Accordingly, when impact occurs, there is a surge in current drawn by the motor. The detector 62 can therefore be a current detector that monitors the current drawn by the motor. A current surge will be detected by the detector as a sudden spike or increase in current, and this condition will be communicated to the controller 8 to cause the first speed driving of the drive rod to be switched off. Other operational parameters of the motor undergo change with the increased load, so can be similarly monitored to detect when contact is made between the drive rod and the plunger. For example, the rotational speed of the motor will change for a fixed power. Other parameters may be apparent to the skilled person and may alternatively be monitored as well.

The drive rod may be provided with a compressible member on its end, such as a spring or a foam portion. This will compress when contact is made with the plunger and cause a more gradual change in the load on the motor. This can be still be detected, however and the drive rod brought to a halt (or switched to a slower speed) while compression is still ongoing so that no movement is imparted to the plunger.

Figure 9:
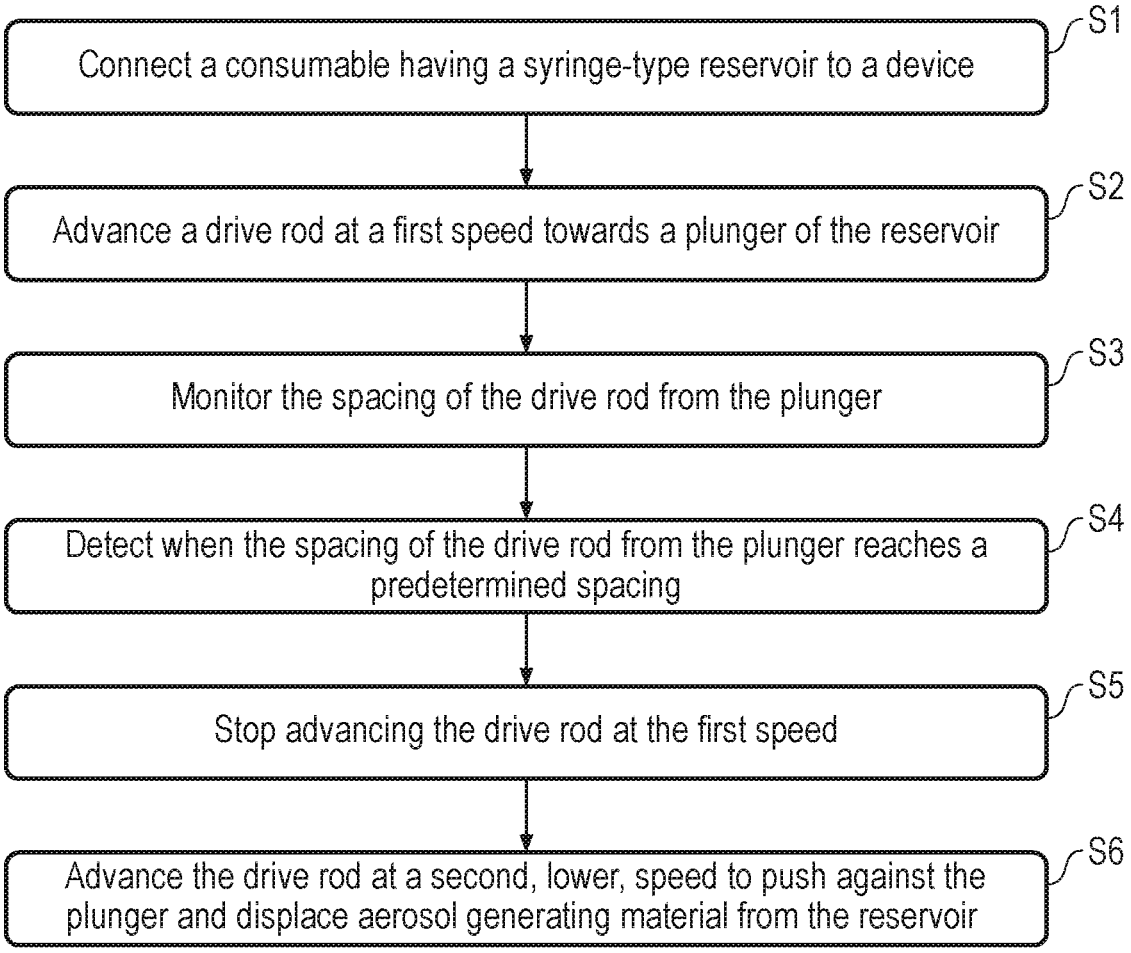
FIG. 9 shows a flow chart of a method for driving a push applicator according to an example of the present disclosure.

FIG. 9 shows a flow chart of an example method for operating a push assembly such as a drive rod in a device of an aerosol provision system in accordance with the present disclosure. In S1, a consumable having a syringe-type reservoir with a movable wall or plunger is connected to or coupled to a device in order to form an aerosol provision system. In S2, a drive rod or similar push applicator occupying a retracted position in the device is advanced or moved towards the plunger at a first speed. While the movement at the first speed is ongoing, the spacing between the drive rod and the plunger is detected or measured in order that the spacing can be monitored, in S3. Next, in S4, the monitoring of the spacing is used to detect when the spacing reaches a predetermined spacing, which may be, for example, a zero spacing such that the drive rod is in contact with the plunger, or a positive spacing such that there is a small separation between the drive rod and the plunger. Once the predetermined spacing is reached, in S5 the advancement of the drive rod at the first speed is stopped, in response to the predetermined spacing being achieved. Subsequently, when aerosol provision is required, the method moves to S6 in which the drive rod is advanced at a second speed which is slower than the first speed in order to push against the plunger and move it inwardly. This reduces the volume of the reservoir and causes aerosol generating material in the reservoir to be expelled through an outlet in the reservoir, thereby making the material available to be vaporized.

More generally, the concept of dual-speed driving of the drive rod can be implemented without the proximity detection. For example if the consumable is configured such that it can only be coupled to a device when the reservoir is full, and the plunger position is therefore fixed between consumables, the distance over which the drive rod needs be moved to take it from its retracted position to the location for pushing against the plunger is always constant, for every consumable. Accordingly, the drive rod can be advanced at the first speed in order to cover the necessary distance. Subsequently, when aerosol generation is desired and it is necessary to dispense aerosol generating material from the reservoir, the drive rod is advanced at the second, slower, speed to push the plunger forward and displace material through the reservoir outlet. Operation of the motor in order to carry the drive rod over the required distance at the first speed can be for a number of revolutions of the motor known to correspond to that distance for example. An encoder could also be used to track the distance. Another alternative is to operate the motor at the first speed for a fixed time corresponding to the distance, but this approach may be less robust since factors such as differences in voltage available from the battery or varying friction would cause variations in the distance for which the drive rod would be moved in the fixed time.

Consequently, the example method of FIG. 9 can be implemented without S3 and S4, and a device component for use with a consumable component having a syringe-style reservoir with a plunger can be implemented with a push applicator such as a drive rod operable to driven at two speeds, without the proximity detector.

In all examples and embodiments, the various speeds, in particular the first speed and the second speed, can be selected having regard to the overall design of the aerosol provision system in order to achieve the desired reduced speed for dispensing the aerosol generating material together with a minimal delay in engaging the drive rod and the plunger after the device and the consumable are connected together. The slower second speed can be a function of an output power for the system selected by the user since this is related to the mass of aerosol generating material that needs to be dispensed for vaporization. The absolute value for the second speed will depend on aspect ratio of the consumable and the cross-sectional area of the reservoir since this determines the amount of aerosol generating material dispensed per given distance travelled by the plunger.

Examples above have been described in terms of the controller positively controlling the motor to operate at the various different speeds when it is known that the drive rod is in any of the corresponding positions. However, this positive control may not be necessary, and the required slower second speed may arise by default as a consequence of motor operation. If the motor is supplied with an appropriate constant power level, it will operate to move the drive rod at a corresponding first speed while the motor is loaded only with the drive rod. When the drive rod contacts the plunger, the load on the motor increases as it works to push the plunger and displace the aerosol generating material out of the reservoir, and if the power is maintained at the same level, the speed will decrease, thereby producing the slower second speed by default.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure as defined by the claims or limitations on equivalents to the claims, and that other embodiments may be utilized and modifications may be made without departing from the scope of the claims. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A device component for an aerosol provision system, the device component comprising:

a drive rod for pushing against a movable plunger in order to displace aerosol generating material through an outlet of a reservoir for storing the aerosol generating material;

a proximity detector configured to detect a spacing of the drive rod from the plunger;

a drive assembly operable to advance the drive rod in a pushing direction, at a first speed to approach the plunger and at a second speed when against the plunger to move the plunger in order to displace the aerosol generating material, the first speed being faster than the second speed; and a controller configured to operate the drive assembly to advance the drive rod at the first speed when the spacing of the drive rod from the plunger exceeds a predetermined spacing, and to cease advancing the drive rod at the first speed when the spacing is substantially equal to or less than the predetermined spacing.

2. The device component according to claim 1, wherein the controller is configured to cease advancing the drive rod at the first speed when the drive rod is located for pushing against the plunger.

3. The device component according to claim 1, wherein the controller is configured, after ceasing advancing the drive rod at the first speed, to operate the drive assembly to advance the drive rod at a speed slower than the first speed to locate the drive rod for pushing against the plunger.

4. The device component according to claim 3, wherein the slower speed is the second speed.

5. The device component according to claim 2, wherein, when the drive rod is located for pushing against the plunger, the drive rod is in contact with the plunger.

6. The device component according to claim 2, wherein, when the drive rod is located for pushing against the plunger, the drive rod is spaced from the plunger in order to be brought into contact with the plunger by operation of the drive assembly to advance the drive rod at the second speed or another speed slower than the first speed when the aerosol generating material is required to be displaced from the reservoir.

7. The device component according to claim 2, wherein the controller is further configured to operate the drive assembly to advance the drive rod at the second speed when the drive rod is against the plunger and the aerosol generating material is required to be displaced from the reservoir.

8. The device component according to claim 1, further being configured for connection to a consumable component of an aerosol provision system, the consumable component comprising the movable plunger and the reservoir for storing the aerosol generating material, and the drive rod being operable to push against the plunger when the device component is connected to the consumable component.

9. The device component according to claim 1, wherein the proximity detector comprises a capacitive sensor mounted on the drive rod in order to detect a capacitance between the capacitive sensor and an element comprising or comprised in the plunger or the reservoir, the predetermined spacing corresponding to a particular value of capacitance.

10. The device component according to a claim 1, wherein the proximity detector comprises a time-of-flight sensor mounted on the drive rod in order to measure a distance from the drive rod to the plunger, the predetermined spacing corresponding to a particular distance.

11. The device component according to claim 1, wherein the drive assembly comprises an electric motor, and the proximity detector comprises a detector operable to detect a change in an electrical parameter associated with the electric motor produced when the drive rod being advanced at the first speed impacts the plunger, the predetermined spacing being a spacing of zero.

12. The device component according to claim 11, wherein the detector comprises a current detector operable to detect an increase in current drawn by the electric motor when the drive impacts the plunger.

13. An aerosol provision system comprising:

the device component according to claim 1; and a consumable component configured for connection to the device component and comprising the reservoir for storing the aerosol generating material and the movable plunger for displacing the aerosol generating material through the outlet of the reservoir when pushed by the drive rod of the device component.

14. A method for dispensing aerosol generating material from a reservoir in an aerosol provision system, the method comprising:

advancing a drive rod in a pushing direction at a first speed to approach a movable plunger for displacing aerosol generating material through an outlet of a reservoir for storing the aerosol generating material, from a spacing of the drive rod from the plunger that exceeds a predetermined spacing of the drive rod from the plunger;

using a proximity detector to monitor the spacing of the drive rod from the plunger during the advancing at the first speed;

ceasing the advancing at the first speed when the proximity detector indicates that the spacing is substantially equal to or less than the predetermined spacing; and subsequently, when the aerosol generating material is required to be displaced from the reservoir, advancing the drive rod against the plunger to push the plunger to displace the aerosol generating material through the outlet, at a second speed which is slower than the first speed.

15. A device component for an aerosol provision system, the device component comprising:

a drive rod for pushing against a movable plunger in order to displace aerosol generating material through an outlet of a reservoir for storing the aerosol generating material;

a proximity detector configured to detect a spacing of the drive rod from the plunger;

a drive assembly operable to advance the drive rod in a pushing direction, at a first speed to approach the plunger and at a second speed when against the plunger to move the plunger in order to displace the aerosol generating material, the first speed being faster than the second speed; and a controller configured to:

operate the drive assembly to advance the drive rod at the first speed when the spacing of the drive rod from the plunger exceeds a predetermined spacing and to cease advancing the drive rod at the first speed when the spacing of the drive rod from the plunger is substantially equal to the predetermined spacing, and operate the drive assembly to advance the drive rod at the second speed to move the plunger to displace aerosol generating material when aerosol generating material is required.

16. A method for dispensing aerosol generating material from a reservoir in an aerosol provision system; the method comprising:

advancing a drive rod in a pushing direction at a first speed to approach a movable plunger for displacing aerosol generating material through an outlet of a reservoir for storing the aerosol generating material, when a spacing of the drive rod from the plunger exceeds a predetermined spacing of the drive rod from the plunger;

using a proximity detector to monitor the spacing of the drive rod from the plunger during the advancing at the first speed;

ceasing the advancing at the first speed when the proximity detector indicates that the spacing of the drive rod from the plunger is substantially equal to the predetermined spacing; and subsequently, when the aerosol generating material is required to be displaced from the reservoir, advancing the drive rod against the plunger to push the plunger to displace the aerosol generating material through the outlet, at a second speed which is slower than the first speed.

* * * * *